US009708100B2

(12) United States Patent
Meinzinger et al.

(10) Patent No.: US 9,708,100 B2
(45) Date of Patent: Jul. 18, 2017

(54) PLASTIC CONTAINER WITH CARRYING HANDLE

(71) Applicant: KRONES AG, Neutraubling (DE)

(72) Inventors: Rupert Meinzinger, Kirchroth (DE); Matthias Pritsch, Herrngiersdorf (DE)

(73) Assignee: KRONES AG (DE)

( * ) Notice: Subject to any disclaimer, the term of this patent is extended or adjusted under 35 U.S.C. 154(b) by 0 days.

(21) Appl. No.: 14/773,788

(22) PCT Filed: Mar. 18, 2014

(86) PCT No.: PCT/EP2014/055434
§ 371 (c)(1),
(2) Date: Sep. 9, 2015

(87) PCT Pub. No.: WO2014/147083
PCT Pub. Date: Sep. 25, 2014

(65) Prior Publication Data

US 2016/0039570 A1 Feb. 11, 2016

(30) Foreign Application Priority Data

Mar. 18, 2013 (DE) ..... 10 2013 102 748

(51) Int. Cl.
*A45F 5/10* (2006.01)
*B65D 23/10* (2006.01)
*B65D 1/02* (2006.01)

(52) U.S. Cl.
CPC ..... *B65D 23/104* (2013.01); *B65D 1/02* (2013.01); *A45F 5/10* (2013.01); *A45F 2200/0583* (2013.01)

(58) Field of Classification Search
CPC ..... A45F 5/10; A45F 2200/0583; B65D 1/02; B65D 23/104
(Continued)

(56) References Cited

U.S. PATENT DOCUMENTS 1,982,276 A 11/1934 West
2,970,729 A * 2/1961 Allen ..... A47J 47/16 24/17 AP
(Continued)

FOREIGN PATENT DOCUMENTS

DE 3530015 A1 2/1987
DE 20114184 U1 11/2001
(Continued)

OTHER PUBLICATIONS

International Search Report; PCT/EP2014/055434; International Filing Date: Mar. 18, 2014; 3 pgs.
(Continued)

*Primary Examiner* — Stephen Castellano
(74) *Attorney, Agent, or Firm* — Schmeiser, Olsen & Watts, LLP

(57) ABSTRACT

A plastic container with a base region, a main body which adjoins this base region and is suitable to receive a volume of liquid, and with a mouth region, wherein a carrying element for carrying the container is disposed on the mouth region is provided. The carrying element is designed to be at least in sections flexible and has a fastening portion by which it can be fastened at least intermittently to the mouth of the container and at least one first gripping portion which is connected to this fastening portion and has an opening through which a region of a human hand can be passed, wherein this opening is delimited by several edge regions, wherein a holding element which is flexible relative to this edge region and extends in the direction of the opening, is disposed on at least one edge region.

12 Claims, 8 Drawing Sheets

(58) Field of Classification Search
USPC ..... 294/31.2, 145, 152
See application file for complete search history.

(56) References Cited

U.S. PATENT DOCUMENTS

| | | | | |
|---|---|---|---|---|
| 3,161,313 | A * | 12/1964 | Sandfort | B65D 23/104 215/307 |
| 5,695,232 | A | 12/1997 | Tipp | |
| 2004/0050815 | A1* | 3/2004 | Blanchester | B65D 23/104 215/399 |
| 2005/0167289 | A1* | 8/2005 | Borg | A45F 5/10 206/151 |
| 2007/0068828 | A1 | 3/2007 | Scarrone | |
| 2013/0015194 | A1* | 1/2013 | Musitelli | B65D 23/104 220/759 |

FOREIGN PATENT DOCUMENTS

| | | | |
|---|---|---|---|
| DE | 10319000 | A1 | 11/2003 |
| DE | 112004002843 | T5 | 5/2007 |
| DE | 60315869 | T2 | 5/2008 |
| DE | 202012011167 | U1 | 12/2012 |
| WO | WO2005112558 | A2 | 12/2005 |

OTHER PUBLICATIONS

Chinese Office Action dated Jun. 3, 2016 Application No. 201480016768.6; Krones AG; 2 pgs.

* cited by examiner

Fig. 1
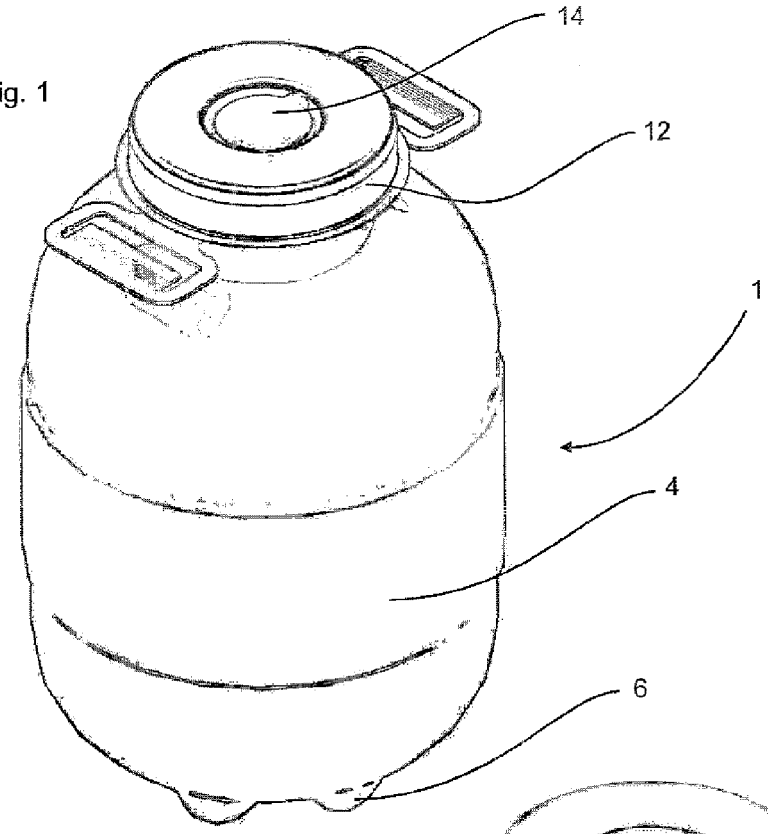
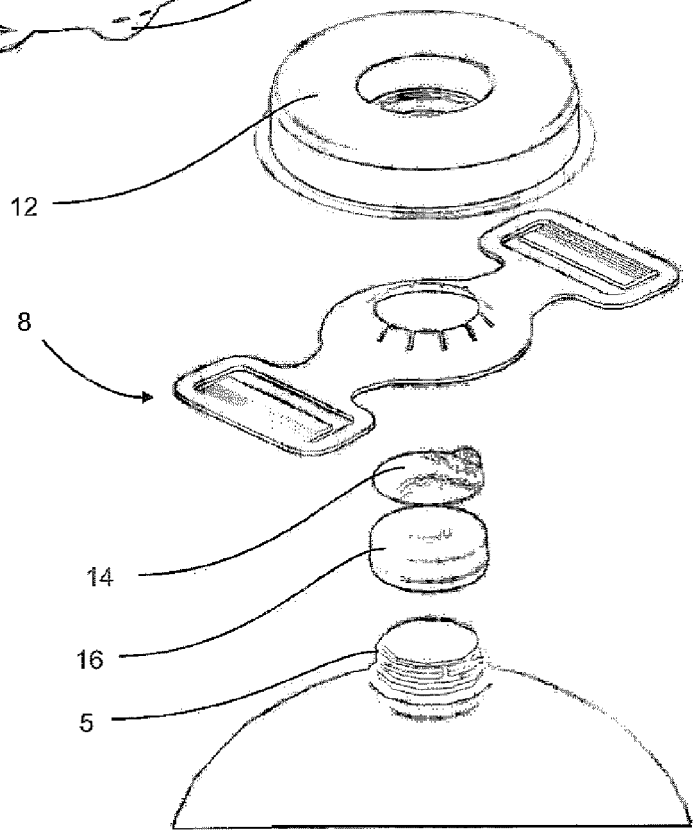
Fig. 2

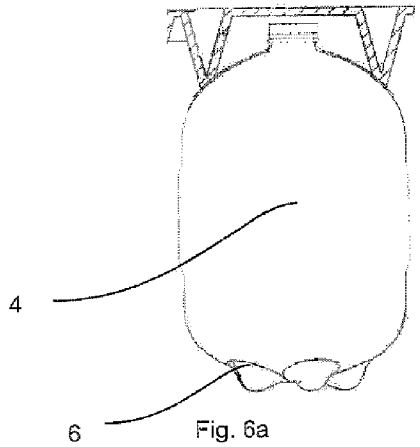
Fig. 6a
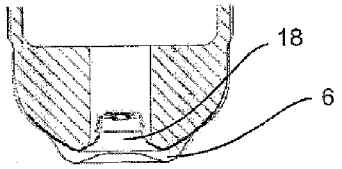
Fig. 6b
Fig. 7a
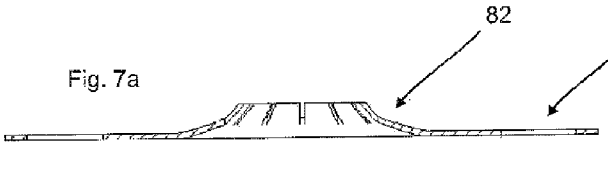
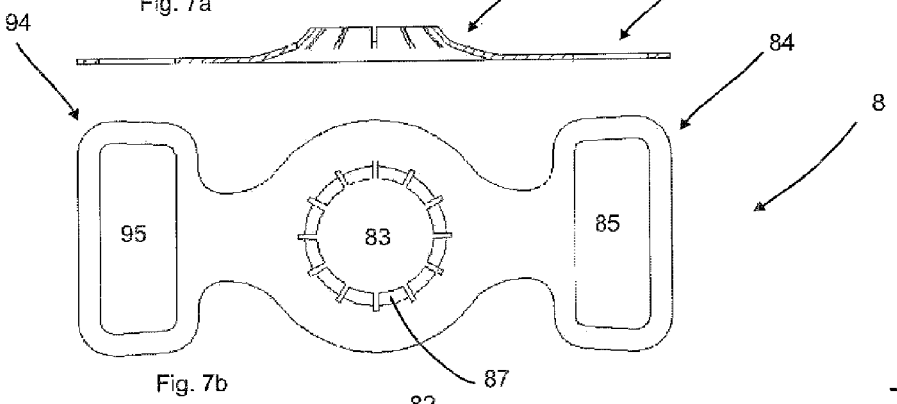
Fig. 7b
Fig. 7c
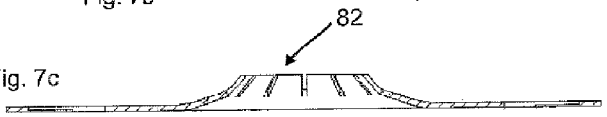
Fig. 7e
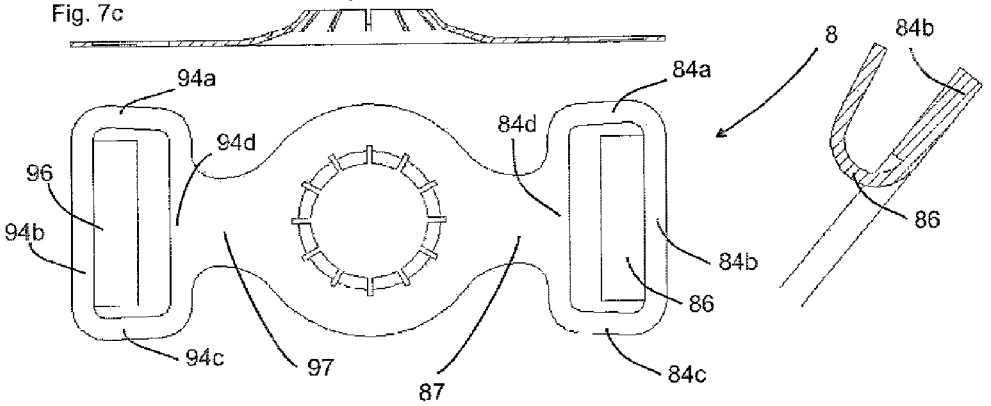
Fig. 7d

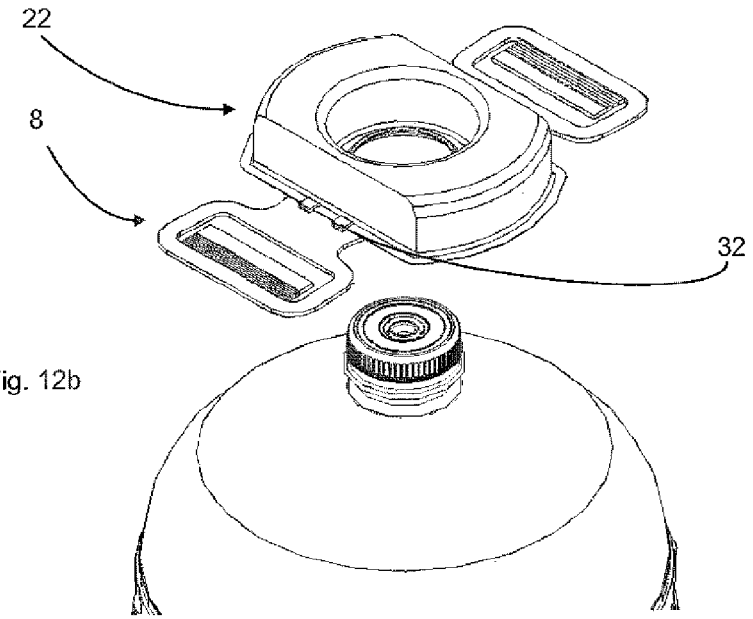
Fig. 12b
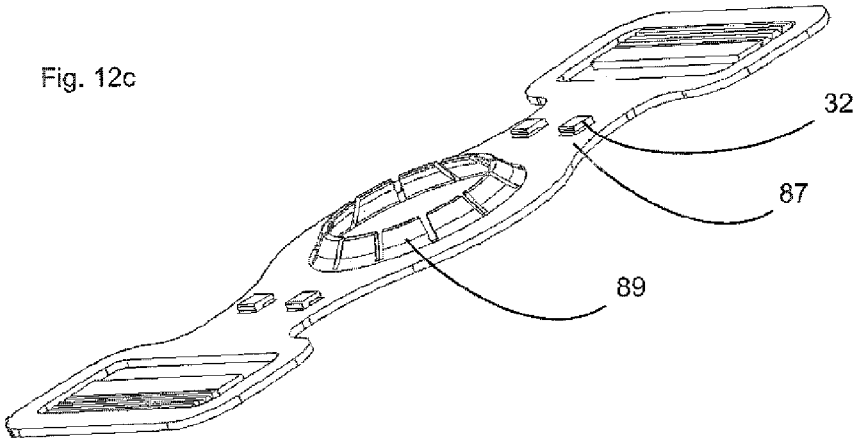
Fig. 12c
Fig. 12d
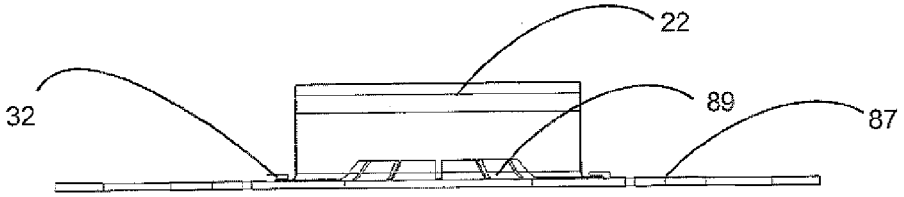

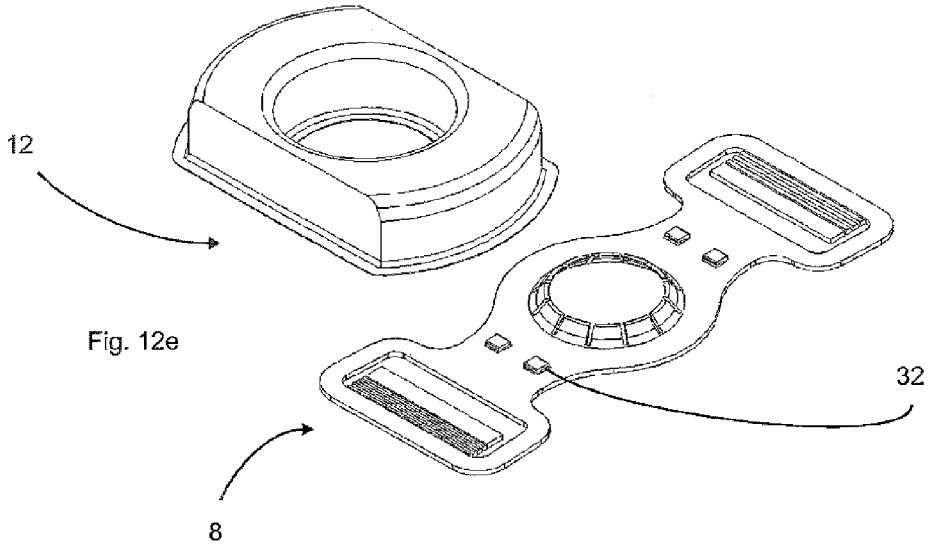
Fig. 12e
Fig. 13
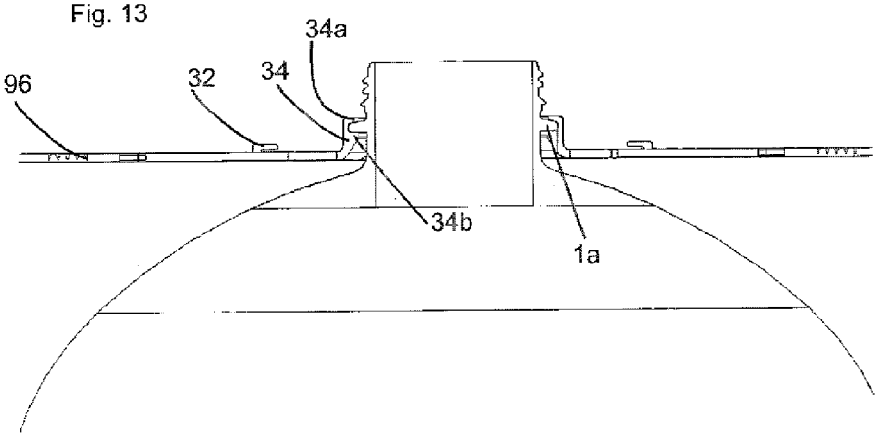

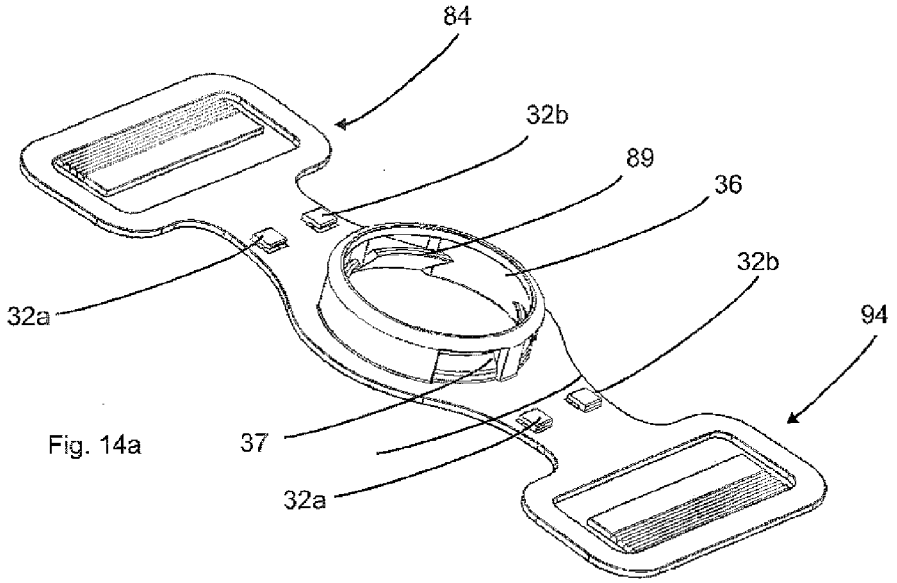
Fig. 14a
Fig. 14b
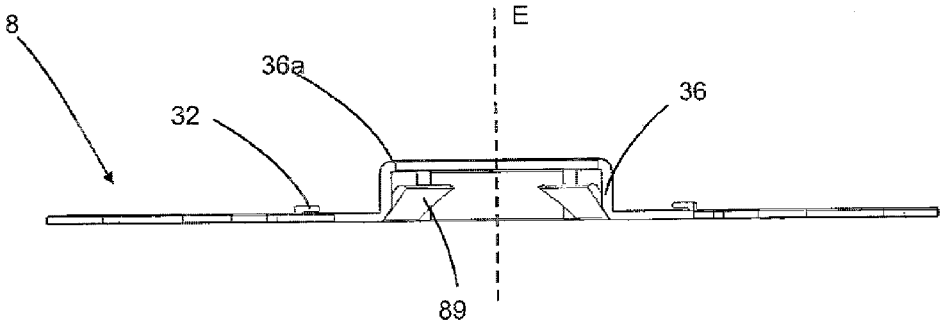
Fig. 15
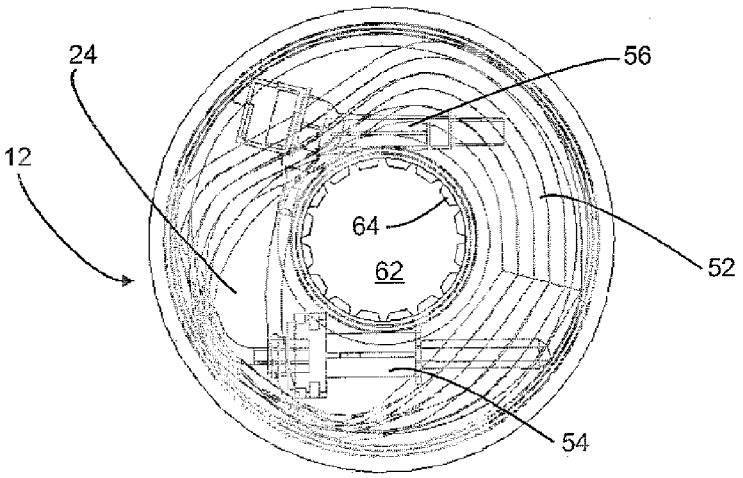

PLASTIC CONTAINER WITH CARRYING HANDLE

CROSS-REFERENCE TO RELATED APPLICATIONS

This application claims priority to PCT Application No. PCT/EP2014/055434, having a filing date of Mar. 18, 2014, based on DE 10 2013 102 748.2, having a filing date of Mar. 18, 2013, the entire contents of which are hereby incorporated by reference.

FIELD OF TECHNOLOGY

The following relates to a container and in particular a plastic container. In particular this is a container which is suitable to receive larger filling quantities, for example filling quantities which are greater than 5 liters, preferably greater than 10 liters and particularly preferably greater than 20 liters.

BACKGROUND

Such containers, also designated as kegs, have been known for a relatively long time. More recently there has been a changeover to manufacturing such containers also from plastic. The transport of such containers usually constitutes a certain problem, since these containers are usually very heavy because of their filling volume.

In principle it would be possible to grip the container in the region of its mouth, for example in the region of a carrying ring which is often present on plastic containers as a result of the production process. However, this is also relatively arduous.

Carrying handles are known from other fields of technology, for example for carrying water bottles. These are designed so that the packages can be carried comfortably with one hand. In order to make the container comfortable to carry, in the past finger flanges with a large surface area are created or finger grooves respectively are provided. For this purpose finger flanges are predetermined with a specific width. Other known carrying handles have the disadvantage that they really cut into the hands, which poses even more problems if the container to be carried has a relatively high weight.

Thus the carrying handles which are known are not usually designed for containers with a volume of for example 20 liters.

SUMMARY

An aspect relates to a device which in particular enables or simplifies carrying of containers which have a large volume or are heavy.

A container according to embodiments of the invention, and in particular a plastic container, has a base region as well as a main body which adjoins this base region and is suitable to accommodate a volume of liquid. Furthermore the container has a mouth region, wherein a carrying element for carrying the container is disposed on this mouth region.

According to embodiments of the invention, the carrying element is designed to be at least in sections flexible and has a fastening portion with which it can be fastened at least intermittently to the mouth of the container. In addition the carrying element has at least one first gripping portion which is connected to this fastening portion and in turn has an opening through which a region of a human hand can be passed. This opening is delimited by a plurality of edge regions, wherein a holding or protective element which is flexible relative to this edge region and extends in the direction of the opening is disposed on at least one edge region.

This holding or protective element advantageously serves for easier carrying of the container. If the user grasps the handle or the said opening respectively, this holding element preferably yields and is bent at a predetermined angle, so that in particular a force is exerted on the user's hand by means of the holding element. Thus the user or his hand no longer comes directly in contact with the respective edge region, but with the bent holding element and thus contacts a smooth surface which causes no pain to the hand. At the same time in the described embodiment the holding element or the fastening element can be of comparatively thin-walled configuration. Thus the container can be carried more easily by this holding element or protective element.

The carrying element is preferably flexible in such a way that if the container on which it is disposed is folded this carrying element adapts at least in sections to deformations of the container. Thus for example the carrying element can rest on a mouth region of the container when the container is folded. In this way it is also possible that a plurality of folded containers are placed in one another, in particular for transport purposes, wherein also in this state the carrying element can be fastened to the individual containers. This configuration is also conceivable independently of the presence of a holding element. The applicant reserves the right also to claim protection for a configuration which does not have the above-mentioned holding element, but a carrying element which is configured to be flexible in such a way that in the context of a container folding process it can be included in the folding. Preferably at least portions of the carrying element are flexible in several directions, and thus can be bent with respect to different geometric axes.

The holding element is preferably disposed on the edge region in the manner of a tab or a flat projection respectively.

The container preferably has a volume which holds at least 5 liters of liquid, preferably at least 10 liters of liquid and preferably at least 15 liters of liquid.

In a further advantageous embodiment this is a foldable container. This means that in particular the main body of the container is configured in such a way that the container can be folded in a defined manner. Advantageously the container can be folded in with respect to a circumferential fold edge. Thus for example a mouth region of the container can be displaced towards a base region, so that in the said folded state these two parts are more or less close to one another. In this way the volume of the container can be drastically reduced (for example for transport purposes). In this case the container can have several cross-sections which are inserted into one another in the context of a folding operation. In this case a mouth region of the container is advantageously folded in from the base region of the container or a circumferential region adjoining it in the longitudinal direction respectively.

The support element is advantageously configured in such a way or is flexible in such a way respectively that during a folding operation it does not hinder this operation and preferably can likewise be correspondingly bent, so that it can be forced for example with a mouth region into a base region.

In a further advantageous embodiment the carrying element is constructed in one piece. Advantageously the carrying element is produced from a plastic. Particularly preferably the carrying element is produced from the same plastic as the container on which it is disposed. Advantageously the carrying element is made from a recyclable material.

In a further advantageous embodiment a flexible transition section which connects the gripping portion and the fastening portion to one another is constructed between the gripping portion and the fastening portion. In this way for the purpose of carrying the container for example the gripping portion can be bent upwards with respect to the closure of the container, so that carrying of the container is simplified overall, since in this state the container is located more or less vertically below the gripping portion.

In a plane of the opening of the gripping portions this transition section preferably has a smaller width than the fastening portion and/or the gripping portion. A width of the transition section is advantageously smaller than a diameter of at least one opening of a gripping portion and/or smaller than a diameter of an opening of the fastening portion (through which a region of a mouth of the container can preferably be passed).

Advantageously the transition portion allows bending by an angle of at least 30°, preferably at least 40°, preferably at least 60°, preferably at least 80°, preferably at least 90°, particularly preferably at least 100°. In this way when the container is carried the gripping portions are bent or adapted respectively in such a way that they are located above the mouth of the container in a vertical direction.

The opening of the gripping portion is advantageously spaced apart by at least 5 cm, preferably at least 10 cm, from the centre point of the opening of the fastening portion. In this way when second gripping portions are provided these are held together by one hand above a mouth of the container and, if required, even above a locking element. In addition, in this way carrying by two persons can also be simplified, since an external circumference of the container or of the main body thereof respectively is not a hindrance when walking.

In a further advantageous embodiment the holding element can be bent by an angle which is greater than 60°, preferably greater than 90°, preferably greater than 120° and particularly preferably greater than 150°. The effect of this bending is that it reduces or completely prevents respectively cutting into the hand which carries the container.

In this way a carrying handle, in particular a two-handed carrying handle, is produced which makes it easier for example to carry a 20 liter container. In this case the holding element is provided as a device which can be easily rolled in or inset respectively, which is bent inwards or outwards during carrying with a specific bend, i.e. a specific bending angle. On both sides of the carrying handle this device which can be rolled in on the one hand increases the support surface in the hand during carrying and in particular because of the bending it also prevents the carrying handle from cutting into the hands. In this way even a 20 liter container for example can be carried over a more considerable distance.

In a further advantageous embodiment the carrying element has a second gripping portion which is connected to the fastening portion and has an opening through which a region of a human hand can be passed. Advantageously in this case the fastening portion is located between these two gripping portions. In this embodiment a carrying device is proposed which is attached on both sides and which, as mentioned above, also makes it possible to carry the container vertically below the handle and thus also can be simply set into a container emptying system.

In a further advantageous embodiment the two gripping portions are disposed symmetrically with respect to the fastening portion. In a further advantageous embodiment the holding element is disposed on the edge region which delimits the opening and which is the greatest distance from the fastening portion with respect to the remaining edge regions delimiting this opening.

In a further advantageous embodiment the fastening portion has an opening through which a mouth portion of the container can be passed. In this embodiment the fastening portion can be pushed over the mouth of the container. Therefore in this embodiment the fastening portion and also the carrying element can preferably also be removed from the container or the mouth thereof respectively.

In a further advantageous embodiment the fastening portion has pretensioning means in order to dispose the fastening portion on the mouth portion of the container. In this case this may involve for example projections or lugs respectively which are directed towards the mouth and which produce a certain pretensioning of the fastening portion relative to the mouth.

In a further advantageous embodiment the container has a locking element which can be removed from the container in order to dispose the carrying element on a mouth region of the container. Thus it is possible that first of all the fastening portion is pushed over the mouth of the container and then for example a rotatable closure is screwed on, so that the fastening portion is also held on the container by this locking element. In this case the said locking element can also form a volume in which for example further components can be provided for tapping liquids, such as for instance a flexible hose-like tap line.

In general the container preferably consists of several elements which can be separated from one another at least in part, wherein at least one of these elements forms a receiving volume, which is completely separate from a filling space, to receive further elements. The applicant reserves the right also to claim protection for such a configuration independently of the features claimed above and in particular independently of the flexible holding element described above.

The container advantageously also has a closure for closing the container. In this case it would be possible that the locking element is simultaneously also constructed as a closure for closing the container, but it would also be conceivable and preferable that the closure and the locking element are two different components. The locking element advantageously has an opening into which at least one portion of the closure can be introduced. In an assembled state of the container it would be possible that the locking element terminates substantially flush with the closure.

Furthermore it would be possible that the locking element is screwed onto the container. In a further preferred embodiment, however, the locking element likewise has an opening which can be placed over a region of the container and/or a closure of the container. On an edge which delimits this opening projections are preferably disposed (in particular individually) which protrude inwards with respect to this opening of the locking element. In this case these projections are advantageously configured flexibly relative to the edge, so that also by means of this opening a secure grip of the locking element on the container is achieved, even if the locking element does not have a thread.

In this case it is also possible that this receiving volume has additional holding means for holding the further elements described above. Thus it would be possible that further equipment is integrated in the volume, such as for example unpackaged one-way lines, packaged one-way lines (for example in blisters), adapter parts for connection to other systems, promotional gifts and/or instructions for use.

In this case for example a packaged one-way line can be disposed in such a way that this line remains in a pallet and also can remain there during carrying, but can be removed for use. For this purpose special holding means can also be disposed on the carrying element. In this case it is conceivable that these holding means are designed in such a way that for example a packaging such as a blister is inserted transversely for example into the carrying element or the locking element and the latter is then fitted onto the container. In this way intrinsic securing of the packaged one-way line is preferably provided. The aforementioned holding means and also the packaging advantageously allow sufficient flexibility in order to deform the carrying element for carrying purposes. Such packages such as for example blisters can advantageously be removed from the holding means without considerable application of force.

Thus in this embodiment the carrying element can be pushed over the screw cap and consequently can also be held by means of a screw cap or can fit thereon respectively. Furthermore it is possible that the container is already supplied with a one-way liquid line and thus a finished complete unit can be supplied together. Consequently, as mentioned above, the locking element advantageously has a preferably round cavity which can be held by means of a screw cap and in which for example line elements are laid. In this case it is possible that such a container which is already provided with a one-way liquid line is prefabricated and a corresponding line is only attached afterwards.

In a further advantageous embodiment grooves and in particular finger grooves are provided on the carrying element. In this case it is possible that the finger flanges are provided widthways with webs or are doubled respectively. In addition it is also possible that reinforcements are provided partially in the carrying element. Therefore the carrying element as a whole is preferably not constructed with a uniform thickness. It is pointed out that this embodiment, in which the carrying handle is constructed in a varying thickness, can also be used independently of the embodiment set out above with the holding element. This means that the arrangement described here with the changing thickness of the carrying element can also serve autonomously in order to increase the carrying comfort.

On the other hand, embodiments of the present invention create a possibility of designing a carrying element also for a heavy container, wherein the carrying element additionally, when it bears on the surface of the container, is not very bulky, in order thus to simplify stacking with a plurality of such containers and in order also to facilitate the emptying by means of a push-in punch. It is therefore possible that the carrying element can also remain on the container during its entire circulation, that is to say from its application through the transport and the emptying up to the recycling of the container. The carrying element makes it possible for a container to be carried by two hands or for a container to be carried by two persons. In addition the gripping element also allows two containers to be carried in one hand. The carrying element makes carrying comfortable and also enables processing in the form of an application to the container using conventional mechanical engineering.

In addition, as mentioned above, further elements, such as lines or also adapter parts or also operating instructions, promotional gifts or the like, can be fixed or disposed respectively.

In a further advantageous embodiment a receiving device to receive further elements is disposed on the container, wherein this receiving device forms a hollow space to receive these further elements. In this case it is possible that this receiving device is also simultaneously the above-mentioned locking element, but various components could also be involved here. In addition it would also be possible that the above-mentioned locking element is not present, but only a receiving device which serves to receive further elements, but has no own locking function. In this case this receiving device is advantageously also disposed above the carrying element and in particular also on the mouth of the container.

In a further advantageous embodiment, the receiving device in an assembled state of the container is disposed at least partially and preferably completely above the carrying element. In this case "above" is understood to mean that in an upright state of the container the receiving device is disposed above the carrying element, i.e. in particular is spaced further apart from the inner volume of the container than the carrying element. In a further preferred embodiment the receiving device enables the said further elements (such as for instance a tap hose) to be received so as to be proof against foreign bodies and in particular dust-proof. In this case it is possible that sealing elements which seal the hollow space on the receiving device are provided. Advantageously the said hollow space can be closed completely. In this way it is possible to dispose the said further elements such as for example hoses or the like hygienically in the said hollow space.

In a further preferred embodiment the receiving device is also at least partially deformable. Also or additionally it would be conceivable that when the container is folded the receiving device is thereby inserted into the base region of the containers. In addition it would also be conceivable that the receiving device in at least one wall region is configured in such a way that a base region of a further container can be disposed at least partially in positive engagement on the receiving device or a wall of this receiving device respectively. Thus it would be possible that a wall delimiting the receiving device is adapted to a contour of the base region of a further container. In addition the receiving device can also be constructed in such a way that a further container or the base region thereof respectively can be disposed on or in this device in a stable manner. In this way a plurality of containers of the type described here can be stacked one inside the other.

In a further advantageous embodiment the carrying element is constructed in one piece with the receiving device. In this case it is conceivable that for example the gripping portions of the type described above are disposed for instance on an outer wall of this receiving device. In this embodiment, in an unloaded state, that is to say a state in which the container is not carried on the gripping portions, these gripping portions preferably also project radially outwards.

Furthermore, embodiments of the present invention are directed to a carrying element for carrying movable bodies. In this case the carrying element is designed to be at least in sections flexible and has a fastening portion with which it can be fastened at least intermittently to the body. This fastening portion has an opening through which at least one portion of the body can be passed, as well as at least one first gripping portion which is connected to the fastening portion and has an opening through which a region of a human hand can be passed. This opening is delimited by several edge regions, wherein a holding element which is flexible relative to this edge region and extends in the direction of the opening is disposed on at least one edge region.

Advantageously the carrying element is constructed in one piece and particularly preferably from a plastic. In this case at least one region of the carrying element is advantageously flexible, so that it can be bent by an angle of more than 30°, preferably more than 60°. Furthermore the holding element is also preferably bendable relative to the edge region on which it is disposed, and preferably, as mentioned above, by an angle of at least 30°, preferably at least 60°, preferably at least 90°, preferably at least 120°.

The several edge regions advantageously form a closed circumference. These are advantageously edge regions which extend at least in sections in a straight line. The opening advantageously has a rectangular cross-section.

In a further advantageous embodiment in the region of the gripping portion the carrying element has a material thickness which is between 1 mm and 10 mm, preferably between 2 mm and 4 mm.

In a further advantageous embodiment, on the fastening portion a plurality of projections is disposed which, in a state in which they are fastened to the body, are directed towards these bodies.

Advantageously the carrying element is detachable from the body which it is intended to carry. In this way the carrying element can be disposed on the body for the sole purpose of carrying and afterwards is detached therefrom again.

BRIEF DESCRIPTION

Some of the embodiments will be described in detail, with reference to the following figures, wherein like designations denote like members, wherein:

FIG. 1 shows a representation of a container with a carrying element disposed thereon;

FIG. 2 shows a representation of the container according to FIG. 1 in an exploded view;

Figure 5A:
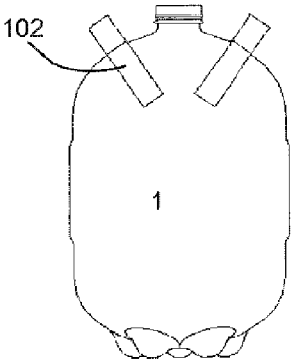
Figure 5B:
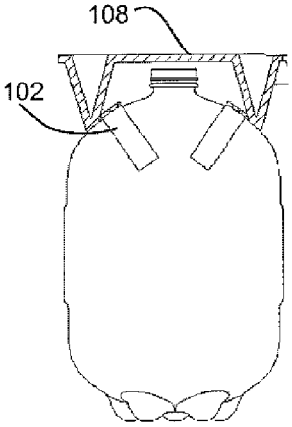
Figure 5C:
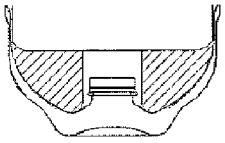
Figure 8A:
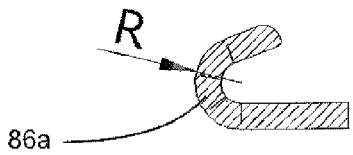
Figure 8B:
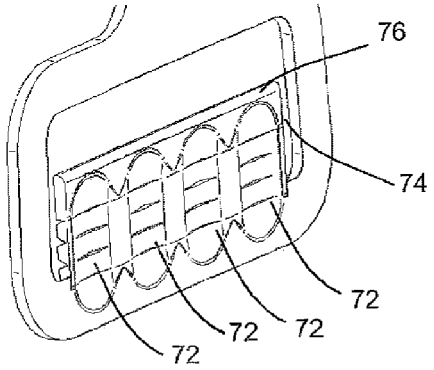
Figure 9:
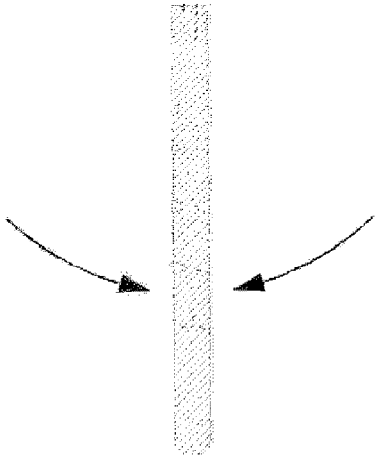

FIGS. 5*a*-5*c* show three representations of the arrangement of a carrying element on a container;

FIGS. 6*a*-6*b* show two further representations of the arrangement of a carrying element on a container;

FIGS. 7*a*-7*e* show five representations of a carrying element;

FIG. 8*a* shows a representation of a holding element;

FIG. 8*b* shows a representation of a carrying element with grip recesses;

FIG. 9 shows a side view of the carrying element shown in FIG. 8*b;*

Figure 10:
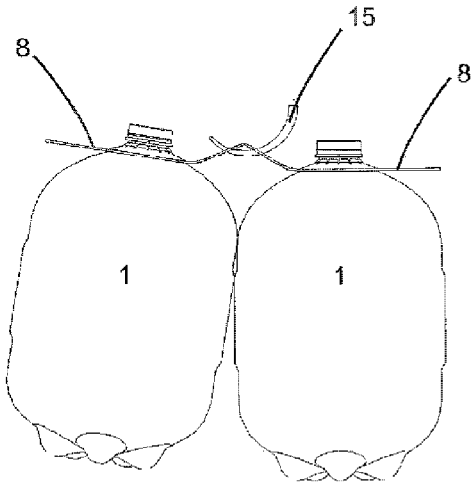
Figure 11:
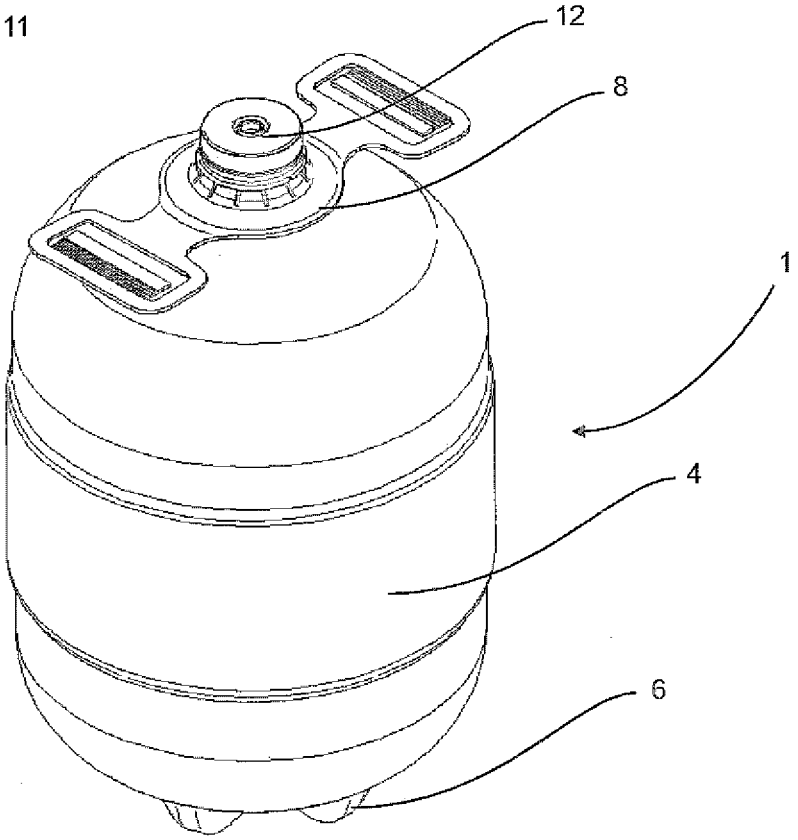
Figure 12A:
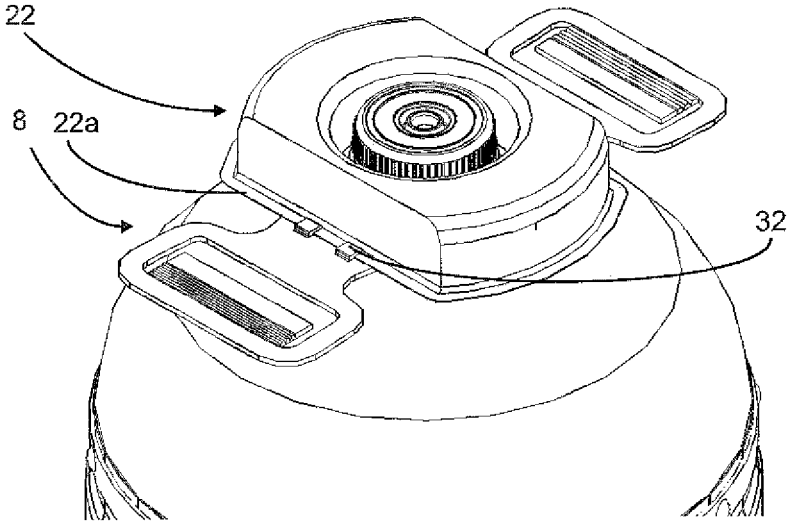

FIG. 10 shows a representation for carrying two containers;

FIG. 11 shows a representation of a container with a carrying element disposed thereon;

FIGS. 12*a*-12*e* show five representations of a further arrangement for carrying a container;

FIG. 13 shows a further advantageous embodiment of the arrangement of a carrying element on a container;

FIGS. 14*a*, 14*b* show two representations of a further advantageous arrangement of a carrying element on a container; and FIG. 15 shows a further representation of a receiving arrangement.

DETAILED DESCRIPTION

FIG. 1 shows a representation of a container with a carrying element 8 disposed thereon. This container 1 has a base portion 6 which preferably also serves as a stand surface. This base region 6 adjoins a main body 4 and in turn a mouth region 5 adjoins this main body 4. On the one hand the carrying element 8 is disposed on this mouth region 5 and a locking element 12 is disposed above this. The reference numeral 14 relates to a seal.

By means of the carrying element 8 the container can be carried by hand. The locking element 12 fastens the carrying element 8 on the mouth of the container 1.

FIG. 2 shows a representation in an exploded view of the container shown in FIG. 1. This also shows the container mouth 5 on which a closure 16 is disposed. This closure 16 is constructed in such a way that it can be pierced in a central region by a tap element in order thus to take liquid from the container. The reference numeral 14 here designates the sealing foil. In this case this sealing foil 14 may be adhesively coated (preferably on one side).

The carrying element 8 is placed over the mouth 5 and then the locking element 12 can be screwed on. During the emptying the region with the mouth 5 can be pushed down and turned over. In this way it is possible that the upper region of the container is pushed into the lower region of the container and so the container is compressed along a circumferential fold edge. It will be seen that the main body 4 has regions with different cross-sections, in particular a central cross-section, which is greater than the lower and the upper cross-section, so that it is possible to push the region comprising the mouth into the base region.

Figure 3:
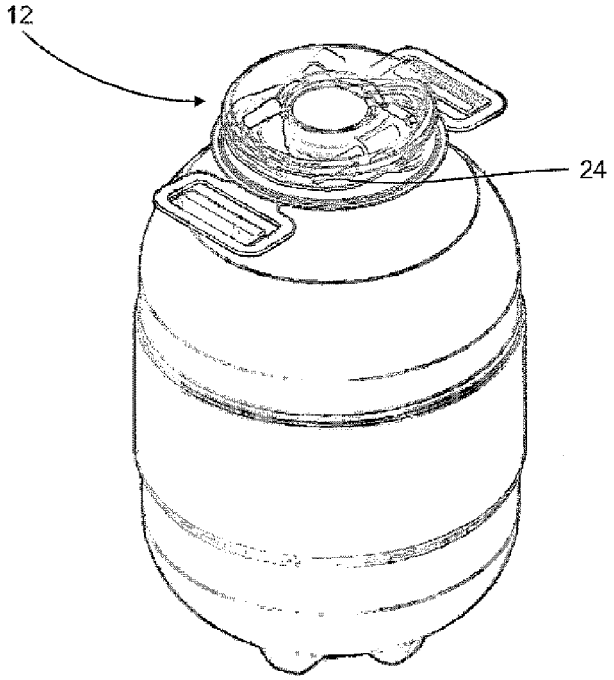
FIG. 3 shows a further representation of a container.

FIG. 3 shows a further representation of a container with a carrying element. It will be seen here that the locking element 12 has in its interior a hollow space 24 in which further elements, such as for example a tap line, are disposed. This hollow space extends here around the region of the mouth of the container and is therefore of toroidal construction.

Figure 4:
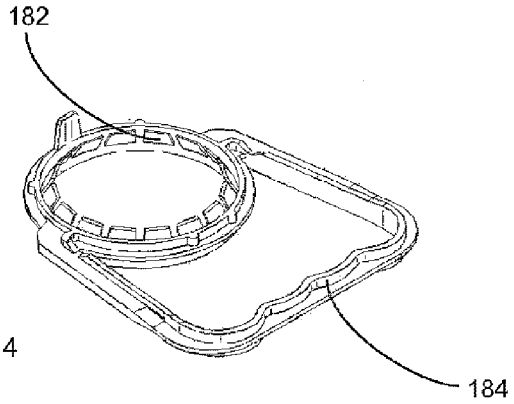
FIG. 4 shows a representation of a carrying element which is known.

FIG. 4 shows a carrying element from the internal prior art of the applicant. A plurality of projections 182 are provided which bear against the mouth region. In addition a gripping element 184 is provided which serves for carrying the container. Due to the configuration shown here it can be relatively painful to carry a particularly heavy container, since the gripping element can cut into the user's hand.

FIGS. 5*a*-5*c* show three representations of a container. In this case the reference numeral 102 relates to fastening portions, such as for example adhesive strips which are disposed on the container. A pallet 108 is disposed on the container. By means of this pallet several containers of the type shown can be stacked one above the other. However, it will be seen that because of this arrangement very strong forces can act on the adhesive region when the container is being carried.

FIG. 6*a* shows a further representation of a container with a holding element disposed thereon. FIG. 6*b* shows a container in a folded-together state, wherein a mouth region 5 is very close to a base region 6.

FIGS. 7*a*-7*e* show a carrying element according to the embodiment. of the invention, in particular for a heavy container. It can be seen on FIG. 7*a* that the carrying element itself is of relatively flat construction. In this case the reference numeral 82 relates to a fastening portion and the reference numeral 84 relates to the gripping portion mentioned above. If the container is to be carried, the user reaches into the opening 85 and into an opposing opening 95 shown in FIG. 7*b*, and in this way these gripping portions bend upwards, so that the container is below the user's hand.

The reference numeral 83 designates an opening via which a mouth of the container can be introduced. The reference numerals 89 relate to projections which, when the carrier element is disposed on the container, are delivered towards the mouth of the container. The fastening portion can also be held reliably on the mouth of the container by these projections 89.

FIGS. 7*c* and 7*d* show a further representation of the carrying element. It will be seen here that the respective gripping portions 84 and 94 in each case have four edge regions 84*a*-84*d* or 94*a*-94*d* respectively. In this case a holding element 86 or 96 respectively is disposed here on the external edge region 84*b* or 94*b* respectively in each case. If the user grasps the gripping portions 84, 94, the respective holding element 86, 96 bends, so that carrying is more comfortable. In other words the holding element or the tab 86, 96 respectively when gripped is folded over automatically and instinctively so that the thin web thereof lying below it or the edge region 84*a*, 94*b* respectively are underlaid in a similar manner as if a further element were folded over. Thus the holding element for example assumes the function of an additionally inserted element, such as for instance a tab or the like.

The holding element 86 advantageously protrudes into the opening 85 or 95 respectively at least as far as the centre of the opening. With regard to the width, the holding element has a width relative to the edge region 84*b* or 94*b* respectively which is between 60% and 95%, preferably between 70% und 95% and particularly preferably between 80% und 90%.

In FIG. 7*d* transition portions or connecting portions 87, 97 respectively are illustrated which connect the fastening portion 82 to the gripping portion 84.

FIG. 7*e* shows a representation in which the holding element 86 is folded upwards as a result of gripping by the user. In this case the user's finger regions bear on the outer region of the holding element 86*a* and because of the significantly higher radius of curvature the holding element causes less pain than the edge region 84*b* or 94*b* respectively.

FIG. 8*a* shows a further representation of the holding element 86. This again shows the region 86*a* which is gripped by the user's hands when carrying the container.

FIG. 8*b* shows a representation in which grip recesses 72 are disposed in the holding element 86 and also in the edge region 84*b*. The reference numeral 74 identifies a cut-out or a recess respectively which enables the bending of the holding element 86 with respect to the edge region 84*b*. The reference numeral 76 identifies an edge region of the holding element 86 which is rounded here. In this case these finger grooves 72 are at likewise in turn adapted to the carrying comfort of the holding element 86.

In order to increase the carrying comfort, the protective tabs or the holding element respectively are as thick as the rest of the handle, in order to achieve a corresponding depth for the configuration of the finger grooves.

For the required flexibility, notches 73 can be provided, as shown in FIG. 9. These notches are advantageously configured in such a way that a predetermined radius is produced.

Furthermore, in FIG. 9 a double-sided introduction into the opening or a double-sided folding over of the holding element respectively is also possible. In this case introduction can take place regardless of direction.

FIG. 10 shows a representation in which two containers 1 can be carried comfortably by a user. The user's hand is symbolised by the reference numeral 15. As mentioned above, two such gripping elements are provided, so that the container could also be carried with two hands or also by two persons each using one hand. In this case the gripping elements or the carrying loops respectively are advantageously co-ordinated with regard to their length so that it is also possible to carry two containers with one hand. In addition the double implementation of the gripping portions 84, 94 indicates the character of a beverage container known from the prior art.

FIG. 11 shows a further representation of a container with a carrying element 8. The gripping element or the carrying element 8 respectively advantageously enable sufficient flexibility in order to deform the handle for carrying purposes. Advantageously a recyclable material is also used for the carrying element 8, so that the container 1 can be disposed of together with the carrying element.

FIGS. 12*a*-12*e* show a further advantageous embodiment of the invention. In this embodiment, in addition to a receiving device 22 for receiving the further elements the carrying element is also provided again. This receiving device 22 preferably has no additional locking function, but is likewise disposed at the mouth of the container.

Fixing elements 32 are provided here on the carrying element 8, in order to fixing the receiving device 22 on the carrying element. For this purpose an outer edge 22*a* of the receiving device can be inserted into the fixing elements 32 inserted and thus fastened to the carrying element. For fastening of the receiving device to the carrying element 8 the receiving device 22 can first of all be pushed onto the mouth. An intervention of the fixing elements 32 can be achieved in that the two gripping portions 84, 94 are pressed downwards and in the event of resetting the edge 22*a* engages in the gap between the carrying element and the fixing elements.

FIG. 12*c* shows a detailed representation of the fixing elements 32 and FIG. 12*d* shows a side view. In this way a secure grip of the receiving device on the carrying element 8 is enabled.

FIG. 13 shows a further advantageous embodiment of a carrying element 8. A supporting collar 34 is provided here which by means of two radially inwardly protruding projections 34*a*, 34*b* surrounds a carrying ring 1*a* of the container and so enables a secure grip on the container mouth. During carrying of the container and the associated folding up of the two gripping portions the delivery of the projections onto the mouth of the container is also promoted.

FIG. 14*a* shows a further advantageous embodiment of a carrying element 8. This likewise has the projections 89 already shown above, which rest against the mouth of the container. In addition, however, a support ring 36 is also provided which is likewise disposed on the carrying element and which in the fitted state completely surrounds the container mouth. In this case in a state in which it is disposed on the mouth, the support ring 36 extends substantially in a longitudinal direction of the container or substantially perpendicular to a plane of the carrying element 8 respectively. "Substantially perpendicular" is understood to mean an angle relative to the plane of the carrying element 8 which is between 70° und 110°, preferably between 80° and 100° und particularly preferably between 85° und 95°.

In this support ring 36 recesses 37 are disposed, within which the projections 89 extend obliquely inwards. The advancing force onto the mouth is increased by this support ring 36, in particular if the container is carried.

In this case the recesses 37 are advantageously disposed at least partially so that they can be penetrated by a straight line which extends between the two gripping portions 84, 94. In this way, while the container is being carried the projections 89 are advanced to the mouth of the container automatically due to bending upwards of the gripping portions 84, 94.

Four recesses 37 are advantageously provided here. These recesses are preferably disposed symmetrically with respect to a plane of symmetry E (FIG. 14*b*), with respect to which the two gripping portions 84, 94 also lie symmetrically without intersect them. This plane of symmetry E extends perpendicular to the drawing plane. In addition, however, the recesses 37 are also disposed symmetrically with respect to a plane which in FIG. 14 coincides with the drawing plane.

The reference numeral 36*a* identifies a radially inwardly protruding projection, which likewise surrounds the mouth of the container over the entire periphery and is delivered towards the container. This projection is disposed on the carrying ring 36.

FIG. 15 shows a further representation of the receiving device 22. It can be seen here that a hose element 52, a piercing device 54 as well as a further tap element 56 are disposed herein, the piercing device 54 and the further tap element 56 being connected to one another by means of the hose element 52. The reference numeral 64 designates projections which, when the carrier element is fastened to the container, are delivered towards the mouth of the container. The reference numeral 62 designates the opening which is placed over the mouth of the container.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

LIST OF REFERENCE SIGNS

1 container
1*a* outer edge
4 main body
5 container mouth, mouth region
6 base portion
8 carrying element
12 locking element
14 sealing
15 hand of the user
16 closure
22 receiving device
22*a* outer edge
24 hollow space
32, 32*a*, 32*b* fixing element
34 supporting collar
34*a*, 34*b* radially inwardly protruding projection
36 support ring
36*a* projection
37 recess
52 hose element
54 piercing device
56 tap element
62 opening
66 projections
72 grip recesses
73 notches
74 cutout
76 rounded edge region
82 fastening portion
83 opening
84 gripping portion
84*a*-84*d* edge regions
85 opening
86 holding element
86*a* outer region of the holding element
87 projections/connecting portion
89 projections
94 gripping portion
94*a*-94*d* edge regions
95 opposing opening
96 holding element
97 connecting portion
102 fastening portions
108 gripping element
182 projections
184 gripping element
E plane of symmetry

The invention claimed is:

1. A plastic container with a base region, a main body which adjoins this base region and is suitable to receive a volume of liquid, and with a mouth region, wherein a carrying element for carrying the container is disposed on the mouth region, wherein: the carrying element is designed to be at least in sections flexible and has a fastening portion by which the carrying element can be fastened at least intermittently to the mouth of the container and at least one first gripping portion which is connected to this fastening portion and has an opening through which a region of a human hand can be passed, wherein this opening is delimited by several edge regions, wherein a holding element which is flexible relative to this edge region and extends in the direction of the opening, is disposed on at least one edge region, wherein there is provided a second gripping portion and the mouth region is located between the two gripping portions, wherein the container has a locking element which can be removed from the container in order to fasten the carrying element to the mouth region of the container, wherein said locking element has a top with an interior hollow space adapted for inserting a tap line.

2. The plastic container according to claim 1, wherein the carrying element is constructed in one piece.

3. The plastic container according to claim 1, wherein between the first gripping portion and the fastening portion a flexible transition portion is formed which connects the gripping portion and the fastening portion to one another.

4. The plastic container according to claim 1, wherein the holding element can be bent by an angle which is greater than 60.

5. The plastic container according to claim 1, wherein the second gripping portion which is connected to the fastening portion has an opening through which a region of a human hand can be passed.

6. The plastic container according to claim 1, wherein the fastening portion has an opening through which the mouth region of the container can be passed.

7. The plastic container according to claim 1, wherein a receiving device to receive further elements is disposed on the container, wherein this receiving device forms a hollow space to receive these further elements.

8. The plastic container according to claim 7, wherein the receiving device in an assembled state of the container is disposed at least partially and preferably completely above the carrying element.

9. The container according to claim 1, wherein the fastening portion has pretensioning means in order to dispose the fastening portion on the mouth region of the container.

10. The container according to claim 1, wherein the container is a foldable container.

11. The container according to claim 10, wherein the container can be folded in with respect to a circumferential fold edge.

12. The container according to claim 1, further comprising a seal in an interior hollow space adapted for piercing to insert the tap line.

* * * * *